US008656905B2

(12) United States Patent
Noman et al.

(10) Patent No.: US 8,656,905 B2
(45) Date of Patent: Feb. 25, 2014

(54) AIR CHANNELING BAFFLE FOR A FURNACE HEAT EXCHANGER

(75) Inventors: Shiblee S. M. Noman, Frisco, TX (US); John W. Whitesitt, Garland, TX (US)

(73) Assignee: Lennox Industries, Inc., Richardson, TX (US)

( * ) Notice: Subject to any disclaimer, the term of this patent is extended or adjusted under 35 U.S.C. 154(b) by 35 days.

(21) Appl. No.: 13/246,916

(22) Filed: Sep. 28, 2011

(65) Prior Publication Data

US 2013/0075062 A1 Mar. 28, 2013

(51) Int. Cl.
*F28F 7/00* (2006.01)

(52) U.S. Cl.
USPC ..... 126/99 D; 126/99 A; 126/110 A; 165/96; 29/428

(58) Field of Classification Search
USPC ..... 431/110 R, 99 D, 110 A, 99 A, 110 B, 431/99 R, 523; 165/170, 159, 401
See application file for complete search history.

(56) References Cited

U.S. PATENT DOCUMENTS

| | | | | |
|---|---|---|---|---|
| 2,257,342 | A | 9/1941 | Lintern | |
| 5,437,263 | A * | 8/1995 | Ellingham et al. | 126/110 R |
| 5,472,339 | A * | 12/1995 | Rakowski et al. | 431/171 |
| 6,564,794 | B1 | 5/2003 | Zia et al. | |
| 6,564,795 | B1 | 5/2003 | Sears et al. | |
| 2003/0127087 | A1 | 7/2003 | Hill et al. | |

OTHER PUBLICATIONS

EPC Search Report; Dec. 11, 2012; 3 pages.

* cited by examiner

*Primary Examiner* — Alfred Basichas
(74) *Attorney, Agent, or Firm* — Hitt Gaines, PC

(57) ABSTRACT

An air-channeling baffle for a heat exchanger unit. The air-channeling baffle comprises a body having a long dimension and a short dimension that define a surface and an attachment structure coupled to the body. The attachment structure is configured to locate the body in a heat exchanger unit such that an incoming air flow reflected off of the surface and passes over ends of the long dimension towards terminally-located heat conduction tubes of the heat exchanger unit.

22 Claims, 6 Drawing Sheets

AIR CHANNELING BAFFLE FOR A FURNACE HEAT EXCHANGER

TECHNICAL FIELD

This application is directed, in general, to heating, ventilation and air conditioning (HVAC) systems and, more specifically, to an air baffle for a furnace heat exchanger of the system.

BACKGROUND

The heat conduction tubes of a heat exchanger can experience so-called "hot-spots" where a portion or the entire heat conduction tube can be higher in surface-temperature than other heat conduction tubes. These hot spots can drastically reduce the reliability of the heat exchanger because the material of the heat conduction tube, after prolonged and repeated exposure to such hot spot, can become brittle and crack. Often to delay such failures, the material of the heat conduction tube is composed of expensive specialty materials such as Drawing Quality High Temperature steel alloy, Extra Deep Drawing Steel or similar material. The use of such materials, however, increases the cost of manufacturing the furnace, and only delays the eventual failure of the heat conduction tube.

SUMMARY

One embodiment of the present disclosure is an air-channeling baffle for a heat exchanger unit. The air-channeling baffle comprises a body having a long dimension and a short dimension that define a surface and an attachment structure coupled to the body. The attachment structure is configured to locate the body in a heat exchanger unit such that an incoming air flow reflected off of the surface and passes over ends of the long dimension towards terminally-located heat conduction tubes of the heat exchanger unit.

Another embodiment of the present disclosure is a method of manufacturing a heating furnace unit. The method comprises providing a channeling baffle. Providing the channeling baffle includes forming a body having a long dimension and a short dimension that define a surface. Providing the channeling baffle includes forming an attachment structure coupled to the body. The attachment structure is configured to locate the body in a heat exchanger unit such that an incoming air flow is reflected off of the surface and passes over ends of the long dimension towards terminally-located heat conduction tubes of the heat exchanger unit.

BRIEF DESCRIPTION

Figure 1:
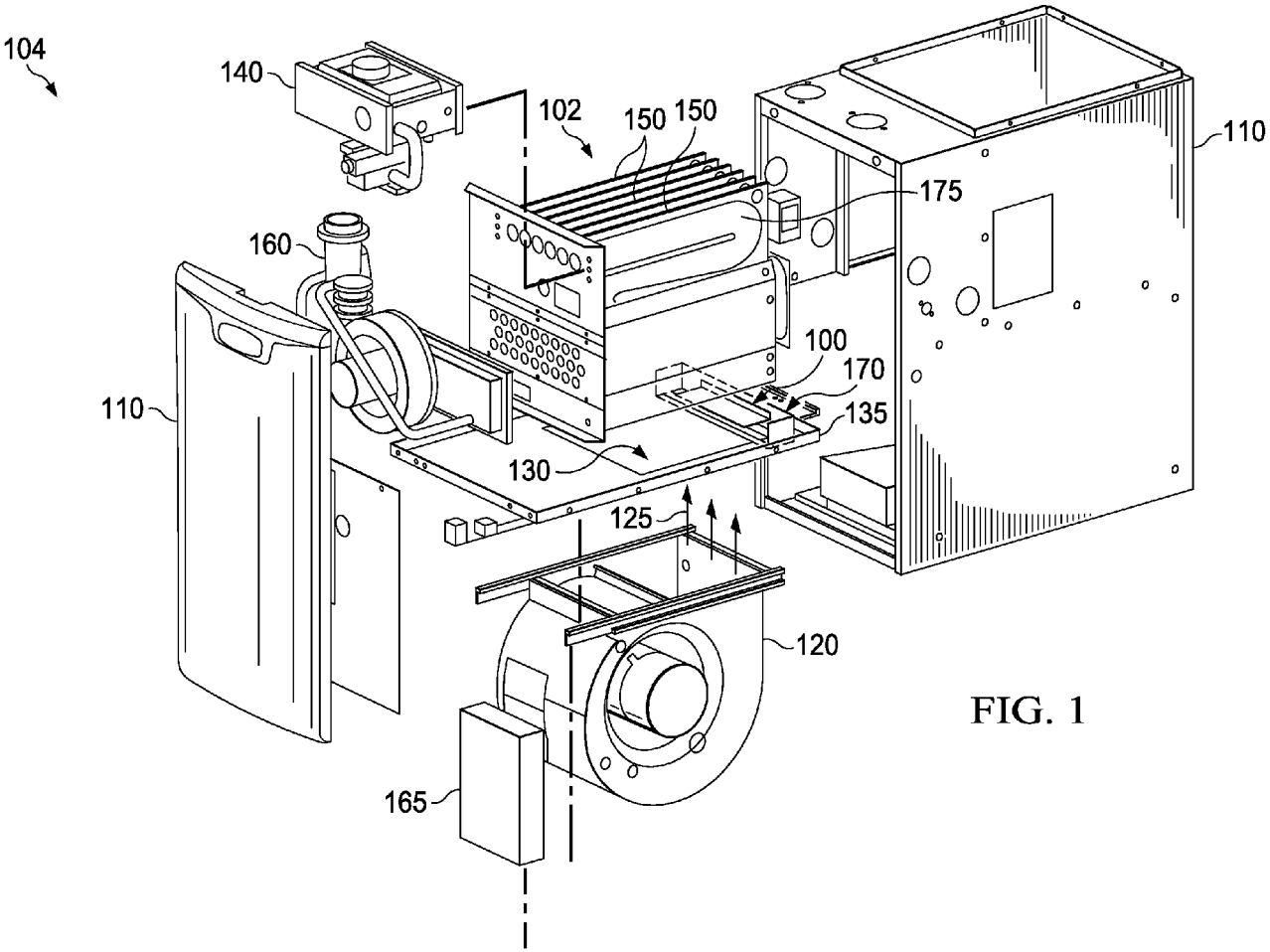
Figure 2:
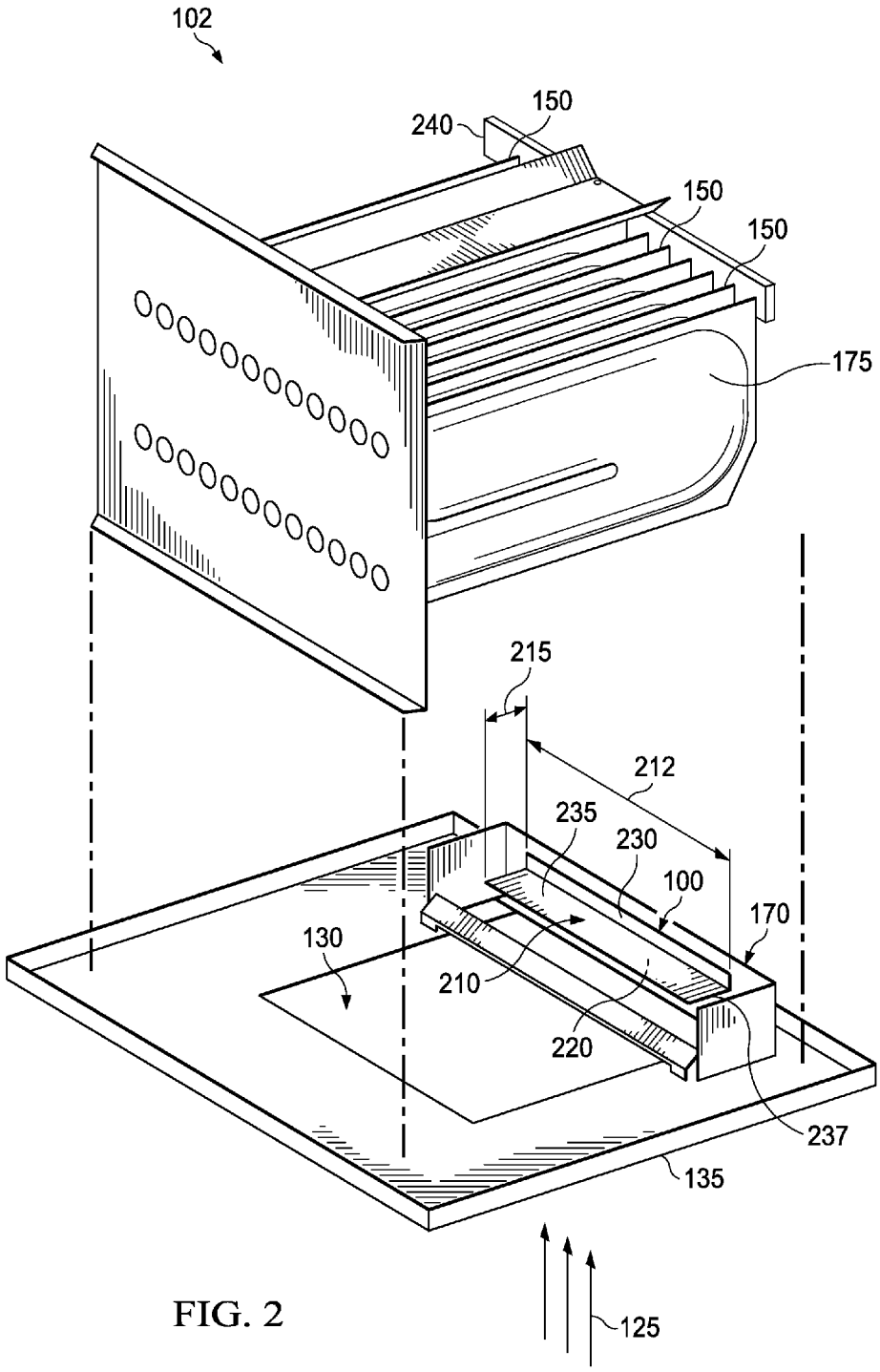
Figure 3:
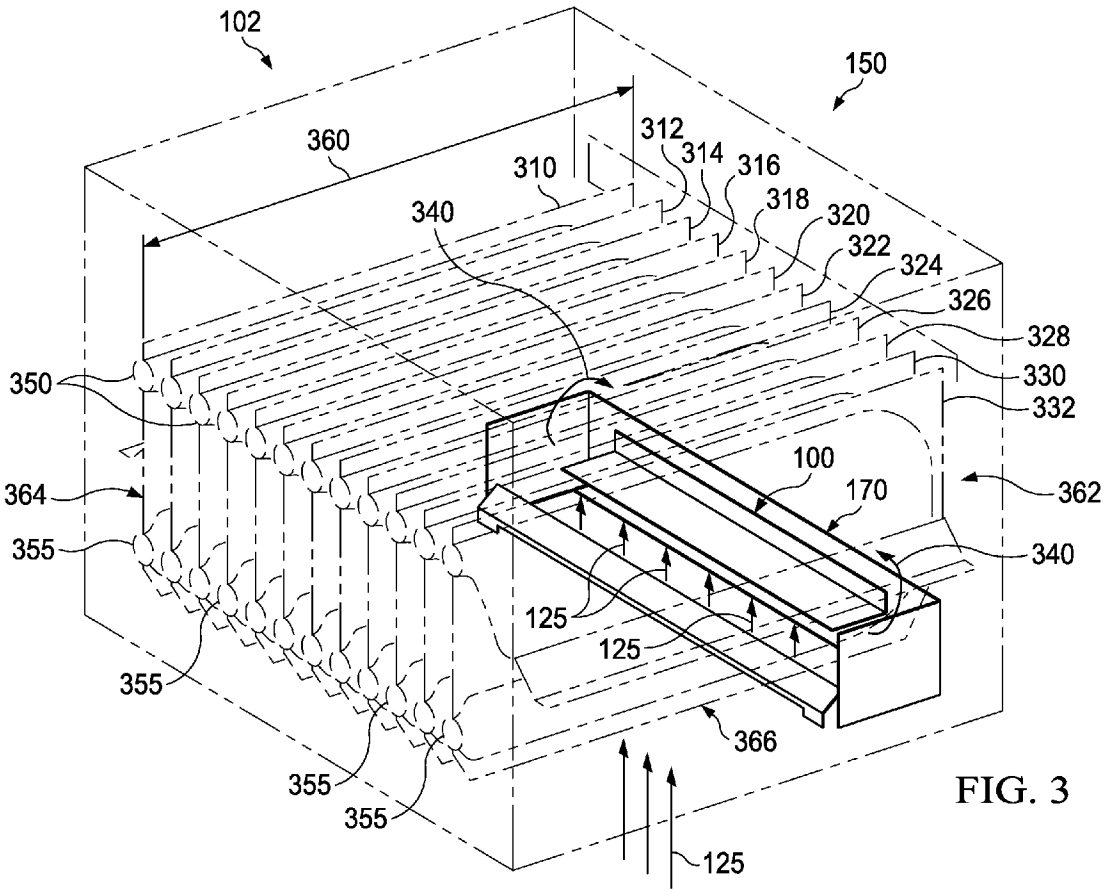
Figure 4A:
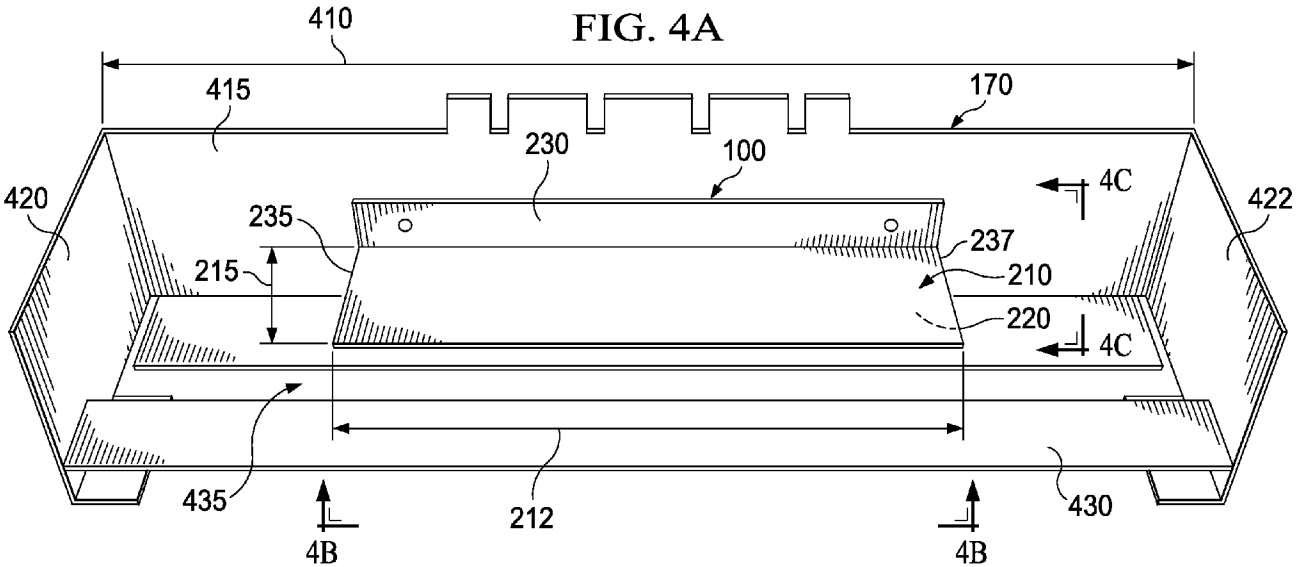
Figure 4C:
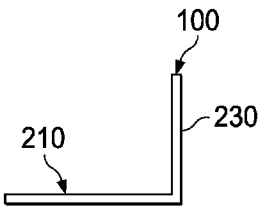
Figure 4B:
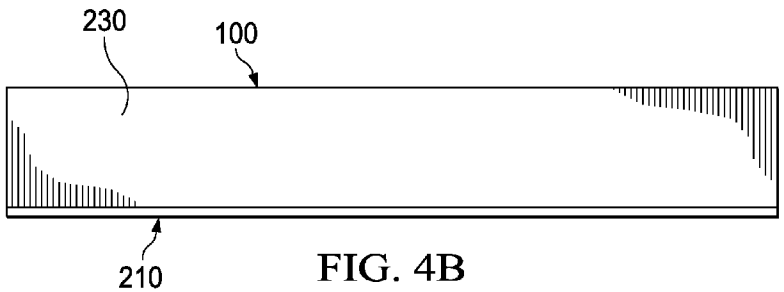
Figure 5A:
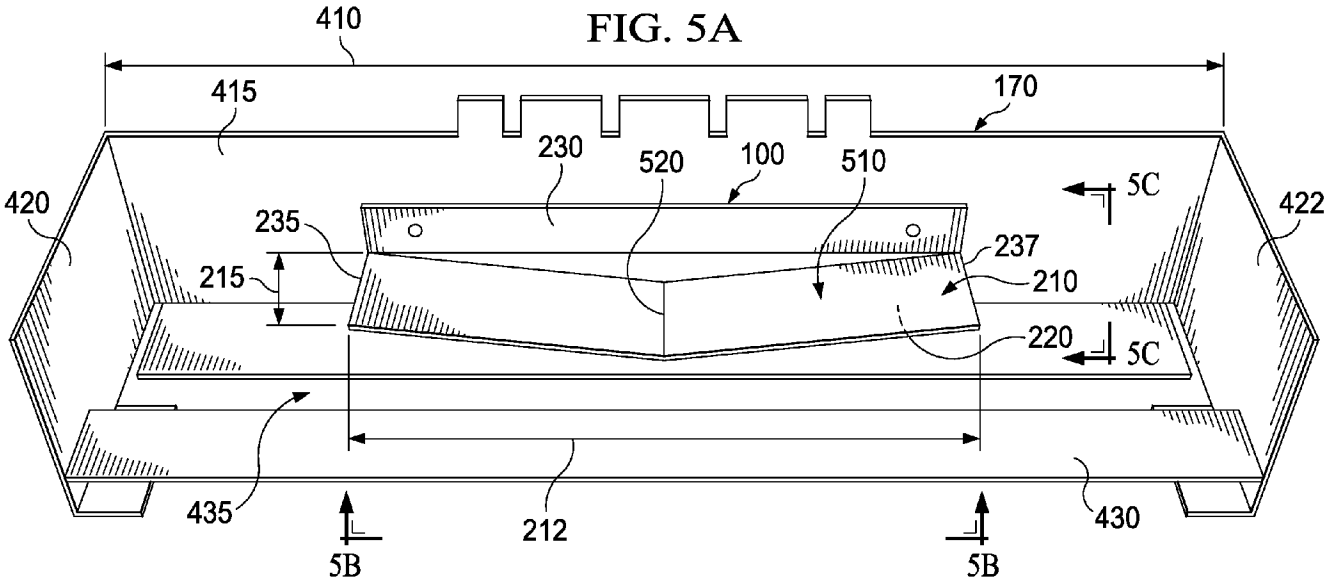
Figure 5C:
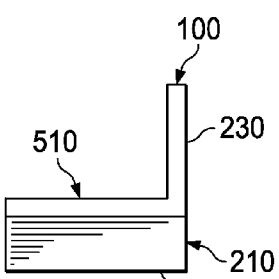
Figure 5B:
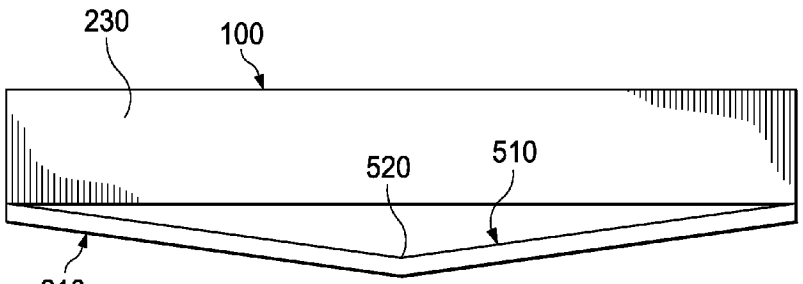
Figure 6:
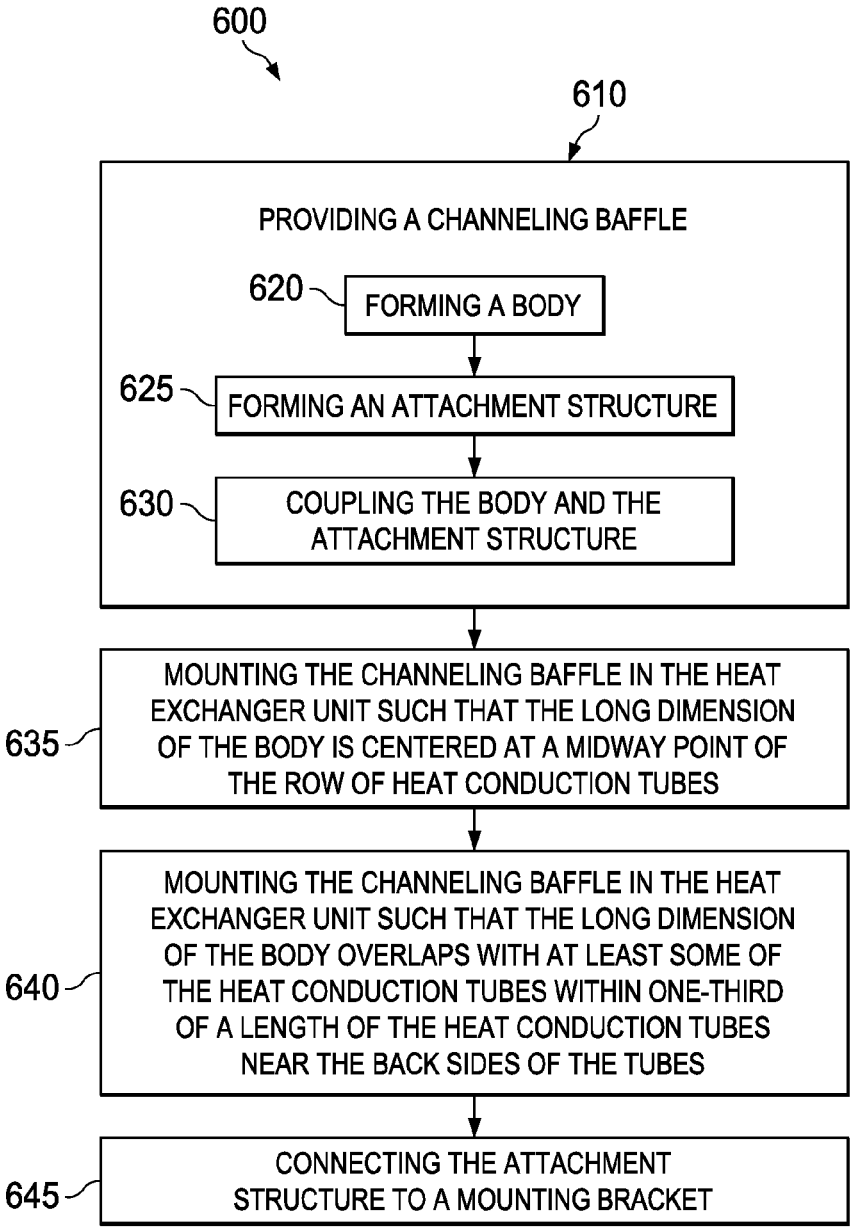

Reference is now made to the following descriptions taken in conjunction with the accompanying drawings, in which:

FIG. 1 illustrates exploded isometric view of an example heating furnace that includes an example air-channeling baffle of the disclosure;

FIG. 2 presents a detailed isometric view of portions of a heat exchange unit, similar to that depicted in FIG. 1, that the air-channeling baffle is part of;

FIG. 3 presents another detailed isometric view of another example air-channeling baffle and portions of a heat exchange unit, similar to the embodiment depicted in FIG. 1;

FIG. 4A presents a three-dimensional view of another example air-channeling baffle of the disclosure;

FIG. 4B presents a front view of the example air-channeling baffle along view line 4B-4B in FIG. 4A;

FIG. 4C presents a side view of the example air-channeling baffle along view line 4C-4C in FIG. 4A;

FIG. 5A presents a three dimensional view of another example air-channeling baffle of the disclosure;

FIG. 5B presents a front view of the example air-channeling baffle along view line 5B-5B in FIG. 5A;

FIG. 5C presents a side view of the example air-channeling baffle along view line 5C-5C in FIG. 5A; and FIG. 6 presents a flow diagram of an example method of manufacturing a heating furnace unit of the disclosure, such as the heating furnace unit and its channeling baffle as depicted in FIGS. 1-5C.

DETAILED DESCRIPTION

The term, "or," as used herein, refers to a non-exclusive or, unless otherwise indicated. Also, the various embodiments described herein are not necessarily mutually exclusive, as some embodiments can be combined with one or more other embodiments to form new embodiments.

As part of the present disclosure, it was discovered that the heat conduction tubes, located at, or next to, either end of a row of such tubes in a heat exchanger unit (referred to herein as terminally-located tubes), can experience significant hot-spots. For example, these terminally-located tubes can have surface temperatures in excess of 1000° F. in some cases, and such surface temperatures can be much higher (e.g., 100 to 300° F. higher in some case) than heat conduction tubes located in the interior of the row of tubes. Consequently, the terminally-located tubes are more prone to failing than more interior-located tubes.

It was further discovered, as part of the present disclosure, that the air flow to the terminally-located heat conduction tubes is lower than the air flow to the tubes located at or near the middle of the row of tubes of the heat exchanger unit. It was discovered that by introducing a baffle configured to channel the air flow towards the terminally-located heat conduction tubes (referred to herein as an "air-channeling baffle"), the air flow to the terminally-located tubes can be increased, thereby reducing the surface temperatures experience by these tubes. This, in turn, is thought to prolong the operating life of the terminally-located tubes and the heat exchanger unit in general.

One embodiment of the disclosure is an air-channeling baffle for a heat exchanger unit.

FIG. 1 is an exploded isometric view of an example air-channeling baffle 100 of the disclosure. The air-channeling baffle 100 can be part of a heat exchanger unit 102. In some embodiments, the air-channeling baffle 100 and the heat exchanger unit 102 can be part of a heating furnace 104. In some embodiments the heating furnace 104 can be a component of a HVAC system (not depicted).

As further depicted in FIG. 1, embodiments of the furnace 104 can include a cabinet 110, and the heat exchanger unit 102 can located within the cabinet 110. The furnace 104 can also include a blower unit 120 located in the cabinet 110 and positioned to force air flow 125 towards the heat exchange unit (e.g., through an opening 130 in a heat exchange deck 135 in some cases).

One of ordinary skill would appreciate that embodiments of the furnace 104 could include other components to facilitate the furnace's operation. For instance, the furnace 100 can also include a burner unit 140 coupled to heat conduction tubes 150 of the heat exchanger unit 102. The furnace 100 can also include a combustion air inducer 160 configured to burn a heating fuel and a control unit 165 configured to coordinate the functions of the various units of the furnace 104 such as depicted in FIG. 1. One of ordinary skill would also appreciate, based on the present disclosure, how the channeling baffle 100 could be used in other types heating furnace units.

FIG. 2 presents a detailed exploded isometric view of the air-channeling baffle 100 and a portion of a heat exchange unit 102 depicted in FIG. 1. As illustrated in FIG. 2, the air-channeling baffle 100 comprises a body 210 having a long dimension 212 and a short dimension 215 that define a surface 220. The air-channeling baffle 100 also comprises an attachment structure 230 coupled to the body 210. The attachment structure 230 is configured to locate the body 210 in the heat exchanger unit 102 such that an incoming air flow 125 reflects off of the surface 220 and passes over ends 235, 237 of the long dimension 212 towards terminally-located ones of the heat conduction tubes 150.

As further illustrated in FIG. 2, in some embodiments of the air-channeling baffle 100, the surface 220 of the body 210 overlaps with the blower deck opening 130 along the average direction of incoming air flow 125, the blower deck opening 130 being located between the blower unit 120 and a row of heat conduction tubes 150. It is desirable for at least a portion of the surface 220 to be located such that the air flow 125 can directly reflect off the surface 220 and be channeled over the ends 235, 237.

FIG. 3 presents another detailed isometric view of the air-channeling baffle and portions of a heat exchange unit similar to the embodiment depicted in FIG. 1. FIG. 3 further illustrates how in some embodiments, the incoming air flow 125 may reflect off of the surface 220 and pass over ends 235, 237 of the long dimension 212 of the body 210 towards terminally-located ones (e.g., one or more of tubes 310, 312, 330, 332 in the example embodiment or tubes adjacent to these tubes in other embodiments) of the heat conduction tubes 150. The channeling baffle 100 thereby facilitates providing additional reflected air flow 340 to, and hence, additional heat exchange of the terminally-located tubes.

As illustrated for the example embodiments depicted in FIGS. 1-3, the surface 220 of the body 210 can be substantially perpendicular to an average direction of the incoming air flow 125 from a blower unit 120 of a heating furnace 104. For instance, the surface 220 can be substantially perpendicular to the incoming air flow 125. The long dimension 212 can be substantially perpendicular to a row 150 of heat conduction tubes (e.g., tubes 310-332 in the example embodiment presented in FIG. 3) of the heat exchanger unit 102 of the heating furnace 104.

As also illustrated for the example embodiments depicted in FIGS. 1-3, in some cases each of the heat conduction tubes 150 can be a clam-shell type of tube, e.g., with two halves that are joined together to form a passageway (e.g., a serpentine passageway in some cases) having an inlet (e.g., inlets 350 in FIG. 3) and an outlet (e.g., outlets 355 in FIG. 3). Each inlet can be coupled to one burner of the burner unit 140 and each outlet can be coupled to the combustion air inducer 160. One skilled in the art would appreciate that other types or styles of conduction tubes 150 could be used as part of other configurations of the heat exchange unit 102.

FIG. 4A presents a three-dimensional view of another example air-channeling baffle 100 of the disclosure, similar to the embodiment depicted in FIG. 1. FIG. 4B presents a front view of the example air-channeling baffle 100 along view line 4B-4B in FIG. 4A. FIG. 4C presents a side view of the example air-channeling baffle 100 along view line 4C-4C in FIG. 4A.

As illustrated in FIGS. 4A-4C, in some embodiments of the channeling baffle 100, the surface 220 can be a planar surface. In some embodiments, having a planar surface can be conducive to minimizing the cost of manufacturing the air-channeling baffle 100 and yet still facilitate the generation of reflected air flow 340 such as discussed elsewhere herein.

FIG. 5A presents a three dimensional view of another example air-channeling baffle of the disclosure, similar to that depicted in FIG. 1. FIG. 5B presents a front view of the example air-channeling baffle 100 along view line 5B-5B in FIG. 4A. FIG. 5C presents a side view of the example air-channeling baffle 100 along view line 5C-5C in FIG. 5A.

As illustrated in FIG. 5A, in some embodiments of the channeling baffle 100, the surface 220 can be a non-planar surface. For instance, the surface 220 can include one or more bends 510. In some cases, the bend 510 is such that the ends 235, 237 of the long dimension 212 are elevated relative to a midpoint 520 of the long dimension 212. In some embodiments, having a non-planar surface 220 is conducive to promoting further reflected air flow 340 or fine-tuning or adjusting of the direction of the reflected air flow 340. Once skilled in the art, based on the present disclosure, would appreciate that the surface 220 could have other shapes to fine-tune or adjust of the direction of the reflected air flow 340.

As further illustrated in FIGS. 4A-4C or 5A-5C, in some embodiments, to minimize fabrication costs, the body 210 and the attachment structure 230 can be part of a same continuous material piece. In some cases, for instance, the body 210 and the attachment structure 230 portions of the channeling baffle 100 can be part of a single piece of steel or steel alloy. However, in other embodiments, the body 210 and the attachment structure 230 can include two or more material pieces that are coupled to together to form the channeling baffle 100.

Returning to FIG. 3, as further illustrated, in some embodiments, the body 210 can be configured to be centered at a midway point of the row of heat conduction tubes 150. For example, in some cases the body 210 can be centered at the middle or the middle two of the heat conduction tubes 150 (e.g., tubes 320, 322 in the example embodiment). Centering the body 210 in this manner can facilitate channeling the reflected air flow 340 evenly over both ends 235, 237 of the long dimension 212.

As also illustrated in FIG. 3, in some embodiments, the long dimension 212 of the body 210 is configured to overlap with one or more of the internally located heat conduction tubes 150 along the average direction of incoming air flow 125. For example, in some cases, the long dimension 212 overlaps with all of the row of heat conduction tubes 150 along the average direction of incoming air flow 125, except for two most terminal heat conduction tubes 310, 312, 330, 332 located at either end of the row of heat conduction tubes 310-332. Configuring the long dimension 212 in this manner can help redirect the air flow 125 towards the terminally-located tubes (e.g., tubes 310, 312, 330, 332).

As also illustrated in FIG. 3, in some embodiments, the long dimension 212 of the body 210 is configured to overlap with some of the heat conduction tubes 150 within one-third of a long dimension length 360 of the heat conduction tubes 150 near back sides 362 of the combustion tubes 150. For the purposes of the present disclosure, the back side 362 of a heat conduction tube is defined as the side opposite to a front side 364 of the tubes that is configured to be connected to a burner unit 140 of the heating furnace 104. Configuring the long dimension 212 in this manner can help facilitate directing the reflected air flow 340 towards the hot spots of the terminally-located tubes 150.

As also illustrated in FIGS. 1-5A, in some embodiments, the attachment structure 230 is configured to be connected to a mounting bracket 170 of the heat exchanger unit 102. The mounting bracket 170, when attached to the heat exchanger unit 102 (e.g., attached to the deck 135 in some cases), is configured to support the heat conduction tubes 150 such that major surfaces 175 of the heat conduction tubes 150 are substantially perpendicular to the incoming air flow 125. For instance, in some cases, a bottom side 366 of each of the heat conduction tubes 150 fits within the mounting bracket 170. In some cases, the mounting bracket 170 is located below the bottom side 366 and the back side 362 of the heat conduction tubes 150. One or more of the heat conduction tubes 150 can be connected to the mount bracket 170. In some cases, as illustrated in FIG. 2, one or more of the heat conduction tubes can alternatively, or additionally, be connected to an upper mounting bracket 240 of the heat exchanger unit 102.

The channeling baffle 100 and the mounting bracket 170 can cooperate to direct the incoming air flow 125 to the terminally-located tubes 150. For instance, as further illustrated in FIG. 4A or FIG. 5A, in some cases, the attachment structure 230 is configured to be connected to the mounting bracket 170 such that the long dimension 212 of the body 210 is parallel to a long dimension 410 of the mounting bracket 170. In some cases, the attachment structure 320 is configured to be connected to a wall 415 of the mounting bracket such that the surface 220 is substantially perpendicular to the wall 415. For example, the attachment structure 320 can be welded, bolted, screwed or otherwise fastened to the back wall 415. Based on the present disclosure, one of ordinary skill would appreciate how the attachment structure 320 could be connected to the mounting bracket 170 at different mounting locations and using a variety of different coupling mechanisms.

As further illustrated in FIG. 4A or FIG. 5A, in some embodiments, the mounting bracket 170 can further include side walls 420, 422 located on either end of the mounting bracket 170 (e.g., the ends 425, 427 of the long dimension 410 of the mounting bracket 170) and the attachment structure 230 can be configured to be connected to the mounting bracket 170 such that there is a space between the ends 235, 237 of the long dimension 212 of body 210 and the side walls 420 422. Attaching the channeling bracket 100 in this fashion facilitates the movement of the reflected air flow 340 through the space between the ends 235, 237 and the side walls 420 422, towards the terminally-located tubes 150.

As also illustrated in FIG. 4A or FIG. 5A, in some embodiments, the mounting bracket 170 further includes a mounting bracket baffle 430 configured to direct the incoming air flow 125 through a gap 435 in the mounting bracket 170. The mounting bracket baffle 430 can be configured to distribute portions of the incoming airflow 125 towards the front side 364 and the back side 362 of the heat conduction tubes 150. In such embodiments, the attachment structure 230 can be configured to be connected to the mounting bracket 170 such that at least a portion of the surface 220 is located above the gap 435. Locating at least a portion of the surface 220 above the gap 435 facilitates directing some of the incoming air flow 125 that travels through the gap 435 to the surface 220 of the body 210 and over its ends 235, 237.

Another embodiment of the present disclosure is a method of manufacturing a heating furnace unit. FIG. 6 presents a flow diagram of an example method 600 of manufacturing a heating furnace unit of the disclosure, such as the heating furnace unit 104 and its channeling baffle 100, as depicted in FIGS. 1-5C, which are referred to throughout.

The method 600 comprises a step 610 of providing a channeling baffle 100. Providing the channeling baffle 100 in step 610 includes a step 620 of forming a body 210 having a long dimension 212 and a short dimension 215 that define a surface 220. Providing the channeling baffle 100 in step 610 also includes a step 625 of forming an attachment structure 230 configured to be coupled to the body 210, wherein the attachment structure 230 is configured to locate the body 210 in a heat exchanger unit 104 such that an incoming air flow 125 is reflected off of the surface 220 and passes over ends 235, 237 of the long dimension 212 towards terminally-located heat conduction tubes 150 of the heat exchanger unit 102.

As part of forming the body 210 and the attachment structure 230 (steps 620, 625) a single material sheet (e.g., a steel or steel alloy sheet) can be cut or bent to form the body 210 and the attachment structure 230. Alternatively, separate material sheets can be cut and bent in steps 620, 625 to form the body 210 and the attachment structure 230, respectively. Then, in a coupling step 630, the body 210 and the attachment structure 230 can be coupled to together via welding, bolting, screwing or similar coupling processes.

The channeling baffle 100 provided in step 610 could comprise any of the embodiments of the channeling baffle 100 discussed in the context of FIGS. 1-5C. For instance, in some cases the average direction 125 of the incoming air from a blower unit 120 of the heating furnace 104 and the long dimension 212 of the channeling baffle 100 are substantially perpendicular to a row of heat conduction tubes 150 of the heat exchanger unit 102 of the heating furnace 104.

Some embodiments of the method 600 further include a step 635 of mounting the channeling baffle 100 in the heat exchanger unit 102 such that the long dimension 212 of the body 210 is centered at a midway point of the row of heat conduction tubes 150.

In some embodiments, the method 600 further include a step 640 of mounting the channeling baffle 100 in the heat exchanger unit 102 such that the long dimension 212 of the body overlaps with at least some of the heat conduction tubes 150 within one-third of a length 360 of the heat conduction tubes 150 near the back sides 362 of the tubes 150

In some embodiments, the method 600 further includes a step 645 of connecting the attachment structure 230 to a mounting bracket 170. The mounting bracket 170, when attached to the heat exchanger unit, can be configured to support the heat conduction tubes 150 such that major surfaces 175 of the heat conduction tubes 170 are substantially perpendicular to the direction of incoming air flow 125.

Based on the present disclosure one skilled in the art would appreciate that there could be other steps to complete to manufacture of the heating furnace unit 104, including, but not limited to: providing a burner assembly 140 having burners located therein; coupling openings 350 of the combustion tubes 150 to the burner assembly 140 such that each of the burners can emit a flame into one of the openings 350; coupling second openings 355 of the combustion tubes 150 to combustion air inducer 160; and placing heat exchanger unit 102 and the blower unit 120 in a cabinet 110 such that the air flow is in the direction 125 towards the heater exchanger unit 102.

Those skilled in the art to which this application relates will appreciate that other and further additions, deletions, substitutions and modifications may be made to the described embodiments.

What is claimed is:

1. An air-channeling baffle for a heat exchanger unit, comprising:

a body having a long dimension and a short dimension that define a surface; and an attachment structure coupled to the body, the attachment structure configured to locate the body in a heat exchanger unit such that an incoming air flow, directed towards a row of internally-located heat conduction tubes of the heat exchanger unit, is reflected off of the surface and thereby passes over ends of the long dimension of the body towards terminally-located heat conduction tubes of the heat exchanger unit, wherein the long dimension of the body overlaps with all of the internally-located heat conduction tubes of the row, except for the terminally-located heat conduction tubes of the row.

2. The baffle of claim 1, wherein the surface is substantially perpendicular to an average direction of the incoming air flow from a blower unit of a heating furnace and the long dimension is substantially perpendicular to the row.

3. The baffle of claim 1, wherein the surface overlaps with a blower deck opening along the average direction of incoming air flow, the blower deck opening being located between a blower unit and the row.

4. The baffle of claim 1, wherein the surface is a planar surface.

5. The baffle of claim 1, wherein the body and the attachment structure are part of a continuous material piece.

6. The baffle of claim 1, wherein the body is configured to be centered at a midway point of the row.

7. The baffle of claim 1, wherein the long dimension is configured to overlap with some of the internally located heat conduction tubes along the average direction of incoming air flow.

8. The baffle of claim 1, wherein the long dimension is configured to overlap with some of the heat conduction tubes within one-third of a long dimension length of the heat conduction tubes near back sides of the combustion tubes, the back sides located opposite to front sides of the heat conduction tubes that are configured to be connected to a burner unit of the heating furnace.

9. The baffle of claim 1, wherein the attachment structure is configured to be connected to a mounting bracket of the heat exchanger unit, wherein the mounting bracket, when attached to the heat exchanger unit, is configured to support the heat conduction tubes such that major surfaces of the heat conduction tubes are substantially perpendicular to the incoming air flow.

10. The baffle of claim 9, wherein mounting bracket is located below a back side and a bottom side of the heat conduction tubes.

11. The baffle of claim 9, wherein the attachment structure is configured to be connected to a mounting bracket such that the long dimension of the body is parallel to a long dimension of the mounting bracket.

12. The baffle of claim 9, wherein the attachment structure is configured to be connected to a wall of the mounting bracket such that the surface is substantially perpendicular to the wall.

13. The baffle of claim 9, wherein the mounting bracket further includes side walls located on either end of the mounting bracket and the attachment structure is configured to be connected to the mounting bracket such that there is a space between the ends of the long dimension of the body and the side walls.

14. The baffle of claim 13, wherein the mounting bracket further includes a baffle configured to direct the incoming air flow through a gap in the mounting bracket towards the surface and the attachment structure is configured to be connected to the mounting bracket such that at least a portion of the surface is located above the gap.

15. The baffle of claim 13, wherein the heating furnace is a component of a HVAC system.

16. The baffle of claim 1, wherein the channel baffle is part of a heat exchanger unit in a heating furnace.

17. The baffle of claim 1, wherein the air reflected off of the surface passes the ends of the long dimension of the body towards the two most terminally-located heat conduction tubes located at either end of the row.

18. An air-channeling baffle for a heat exchanger unit, comprising:

a body having a long dimension and a short dimension that define a surface wherein the surface includes a bend such that the ends of the long dimension are elevated relative to a midpoint of the long dimension; and an attachment structure coupled to the body, the attachment structure configured to locate the body in a heat exchanger unit such that an incoming air flow, directed towards internally-located heat conduction tubes of the heat exchanger unit, is reflected off of the surface and thereby passes over ends of the long dimension of the body towards terminally-located heat conduction tubes of the heat exchanger unit.

19. A method of manufacturing a heating furnace unit, comprising:

providing a channeling baffle, including:

forming a body having a long dimension and a short dimension that define a surface;

forming an attachment structure coupled to the body, wherein the attachment structure is configured to locate the body in a heat exchanger unit such that an incoming air flow, directed towards a row of internally-located heat conduction tubes of the heat exchanger unit, is reflected off of the surface and thereby passes over ends of the long dimension of the body towards terminally-located heat conduction tubes of the heat exchanger unit, wherein the long dimension of the body overlaps with all of the internally-located heat conduction tubes of the row, except for terminally-located heat conduction tubes of the row.

20. The method of claim 19, further including mounting the channeling baffle in the heat exchanger unit such that the long dimension is centered at a midway point of the row.

21. The method of claim 19, further including connecting the attachment structure to a mounting bracket, wherein the mounting bracket, when attached to the heat exchanger unit, is configured to support the row such that major surfaces of the heat conduction tubes are substantially perpendicular to the average direction of incoming air flow.

22. A method of manufacturing a heating furnace unit, comprising:

providing a channeling baffle, including:

forming a body having a long dimension and a short dimension that define a surface, wherein the surface includes a bend such that the ends of the long dimension are elevated relative to a midpoint of the long dimension;

forming an attachment structure coupled to the body, wherein the attachment structure is configured to locate the body in a heat exchanger unit such that an incoming air flow, directed towards internally-located heat conduction tubes of the heat exchanger unit, is reflected off of the surface and thereby passes over ends of the long dimension of the body towards terminally-located heat conduction tubes of the heat exchanger unit.

* * * * *